United States Patent [19]

McKee

[11] 4,122,687

[45] Oct. 31, 1978

[54] REFRIGERATION SYSTEM WITH LOW ENERGY DEFROST

[76] Inventor: Thomas M. McKee, 3003 Iroquois Trail, Hastings, Mich. 49058

[21] Appl. No.: 856,347

[22] Filed: Dec. 1, 1977

Related U.S. Application Data

[62] Division of Ser. No. 749,073, Dec. 9, 1976, abandoned.

[51] Int. Cl.[2] ..... F25D 21/12

[52] U.S. Cl. ..... 62/156; 62/187; 62/282

[58] Field of Search ..... 62/82, 282, 187, 156

[56] References Cited

U.S. PATENT DOCUMENTS

| | | | |
|---|---|---|---|
| 1,705,928 | 3/1929 | Lambert | 62/82 |
| 3,015,217 | 1/1962 | Beemer et al. | 62/187 X |
| 3,048,024 | 8/1962 | Jacobs | 62/156 |
| 3,080,727 | 3/1963 | Devery | 62/156 |
| 3,082,612 | 3/1963 | Beckwith | 62/282 X |

*Primary Examiner*—William E. Wayner
*Attorney, Agent, or Firm*—McGarry & Waters

[57] ABSTRACT

A refrigeration system for a refrigeration unit having an evaporator coil through which cooling fluid is circulated. Air is forced across the evaporator coil and valve means directs the flow of air into an enclosed freezer compartment or alternately to a warmer enclosed refrigerated compartment which has a temperature above 0° C. The air normally passes into the freezer compartment until the evaporator coil reaches a predetermined low temperature, below 0° C., then the flow of cooling fluid through the coils is stopped and the valve means directs the air flow to the refrigerated compartment to defrost the evaporator coil. When the evaporator coil reaches a predetermined high temperature above 0° C., the temperature cooling fluid will once again be circulated through the evaporator coils and the valve means will again direct the air flow through the freezer compartment. Both the freezer compartment and warmer refrigerated compartment have outlets controlled by the valve means leading to the evaporator coil so that the air is directed from either the freezer compartment or warmer refrigeration compartment across the evaporator coil and then back to either the freezer compartment or warmer refrigeration compartment.

3 Claims, 4 Drawing Figures

REFRIGERATION SYSTEM WITH LOW ENERGY DEFROST

This is a division, of application Ser. No. 749,073 filed Dec. 9, 1976, now abandoned.

BACKGROUND OF THE INVENTION

1. Field of the Invention

This invention relates to a defrost system for various types of refrigeration apparatus and more particularly, to an energy saving defrost system which avoids the introduction of external heat to defrost the condenser coils.

2. Description of the Prior Art

The accumulation of frost on evaporator coils has been a problem for many years. To overcome the problem, defrost systems have been developed and have been commercially successful.

The automatic defrost systems now in use employ heating elements to periodically melt the accumulated frost on the evaporators while the compressors are turned off. One such system is disclosed in U.S. Pat. No. 3,126,716 issued to DeWitte on Mar. 31, 1964. The DeWitte reference discloses a defrosting refrigerator wherein a fan circulates air throughout a freezer and refrigerator. A butterfly damper controls the air flow through the inlet of the refrigerator. A second damper controls the air flow to the inlet of the freezer space from the fan. The dampers are controlled by a thermostatically set bulb in the fluid motor. Three defrost heaters are turned on and the compressor is turned off when the temperature sensed near the evaporator is cooled below −4.5° F. When the evaporator reaches a temperature of 37° F., the heaters are turned off and the compressor started. The addition of heat to the system thus utilizes energy to melt ice on the coils and energy to cool the refrigerator to the extent of heat added by the heating coils. Thus, there is a two fold increase in energy requirements as a result of using heater coils for defrosting the evaporator coils.

Another device is disclosed in the U.S. Pat. No. 3,084,520 to Jacobs on Apr. 9, 1963. The Jacobs reference discloses an evaporater positioned above the freezer unit. When the compressor is running, the air passing through the evaporator coils is cooled sufficiently, a valve is opened to allow the cooled air to pass into the freezer unit. When the evaporator coils reach a temperature of 0° F., the compressor is turned off and a heating bulb in the refrigerator unit is energized to promote heated convection currents to pass up behind the freezer unit and pass through the evaporator. The air inlet to the freezer unit is then closed so that the air passes through the evaporator coils to the refrigerator unit. When the air is sufficiently warm to melt the frost on the evaporator coils, the light bulb is shut off and the evaporator is restarted. The Jacobs system, like the DeWitte system, requires the addition of external heat to the system, thereby consuming energy in the defrost step and in the subsequent cooling step.

The U.S. Pat. No. 3,499,295 issued to Brennan on Mar. 10, 1970 discloses a freezer unit having two evaporator coils which alternately cool the air passing therethrough. One evaporator cools the freezer space, while the second evaporator is being defrosted. To this end, the warmed condenser fluid is passed through the defrosting evaporator coils prior to expansion and passing through the cooling evaporator coils. The system requires complex valving for the refrigeration fluid and does add some heat from the refrigeration fluid to the defrost coils. Thus, although the Brennan system avoids energy for the addition of heat inasmuch as the heat is already present in the refrigerator system, it still requires energy to cool the system to the extent that energy has been added to the system for defrosting the evaporator coils.

SUMMARY OF THE INVENTION

According to the invention, a refrigeration unit has a defrost system which defrosts the evaporator coil by passing warmer air across the evaporator coil without the use of external heating means to heat the defrosting air. The refrigeration unit has a housing which contains a freezer compartment. The freezer compartment has apertures in open communication with an air passageway that has an evaporator coil mounted therein. The evaporator coil is operably connected to a compressor and condenser in a conventional refrigeration supply system.

Preferably, the apertures are at opposite sides of the evaporator coil so that air passing from one aperture to the other aperture passes across the evaporator coil.

The air passageway has a second set of two apertures in communication with a warmer air source having a temperature above 0° C. Preferably, the warmer air source is contained in a refrigerated compartment. Preferably, each aperture of the second set are at opposite ends of the evaporator coil.

In one embodiment, the warmer refrigeration compartment is surrounded by insulating walls and is adapted to store refrigerated items.

In another embodiment, the warmer refrigeration compartment is an enclosed air duct surrounding the freezer compartment.

A means for circulating the air, preferably a fan, is mounted within the passageway to draw air from the freezer compartment or warmer refrigeration compartment through the evaporator coil and force the cooled air to the freezer compartment or warmer refrigeration compartment respectively.

Valve means are mounted at the ends of the passageway to control the source of air thereto and to control the destination of effluent air therefrom. Preferably, the valve means are dampers pivotably mounted so that the apertures to the freezer space are closed when the dampers are in one position and the apertures to the warm air compartment are closed when the dampers are in another position.

Means for controlling the valve means are operably connected to the valves. The dampers are solenoids controlled so that when the solenoids are energized, the warm air compartment is closed off and when the solenoids are de-energized, the freezer space is closed off. Preferably, a mounted spring on the dampers positions the dampers to close off the freezer space when the solenoids are de-energized.

Desirably, a shroud extends from the walls of the passageway to encircle the fan to promote efficient circulation of the air therethrough.

A temperature sensitive means is mounted within one of the freezer compartments or passageway for turning off the compressor when the means is cooled to a predetermined low temperature below 0° C. and turning on the compressor when the means is warmed to a predetermined high temperature above 0° C. Preferably, the temperature sensitive means includes a temperature sensitive switch mounted adjacent to the downstream end of the evaporator coil. The temperature sensitive switch means is operably connected to the compressor and solenoids so that when the temperature sensitive switch means is opened, the compressor is turned off and the solenoids are de-energized.

In one embodiment, a second temperature sensitive switch means is mounted within the enclosed refrigerated compartment and operably connected to the solenoids so that after the first temperature sensitive switch means actuates the compressor, the second temperature sensitive switch means overrides the first temperature sensitive switch means until the refrigerator space is cooled to a predetermined set low temperature. When the refrigerator reaches the predetermined low temperature, the second switch means closes to energize the solenoids. In this fashion, the freezer space stays closed and the refrigerated space stays open until the refrigerated space is sufficiently cooled.

In one embodiment, the evaporator is positioned below the freezer space and below the insulating wall of the freezer space. Below the evaporator is a conventional pan with the drain hole and a water drain to drain the melted frost from the evaporator when the compressor is de-energized.

The refrigeration defrost system directs warm air across the evaporator coils for defrosting. The valve means close off the freezer space when the evaporator coils are defrosting so that the freezer space maintains its freezing temperature. In the preferred embodiment, the warm air from the refrigerated space defrosts the evaporator coil, and simultaneously, the refrigerated space is cooled by the same air being directed back therein. The evaporator is thus defrosted by circulating air without the expenditure of any energy to heat the air, thereby conserving considerable energy when compared to the other types of defrost systems.

BRIEF DESCRIPTION OF THE DRAWINGS

Reference will now be made to the accompanying drawings in which.

DETAILED DESCRIPTION OF THE PREFERRED EMBODIMENT

Figure 2:
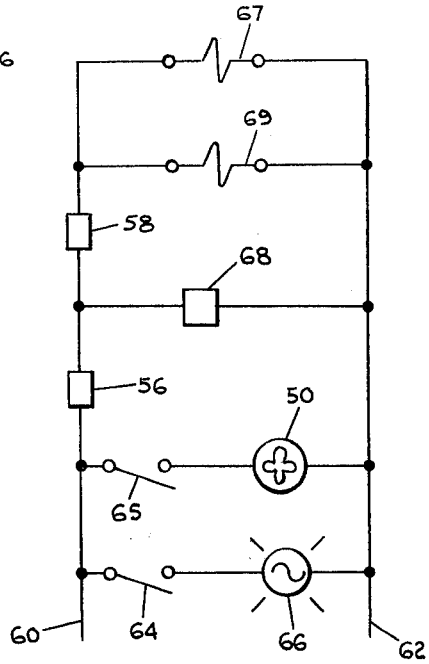
FIG. 2 is a schematic electrical diagram for the embodiment of the invention shown in FIG. 1.

Referring now to the drawings, particularly to FG. 1, a refrigeration unit 10 has a freezer space 12 and refrigerator space 14. A freezer door 16 and refrigerator door 18 provide direct access to the freezer 12 and refrigerator spaces respectively. Positioned below the bottom insulating wall 20 of the freezer space 12 is evaporator coil 22. The evaporator coil 22 is conventionally connected to a condenser (not shown) and a compressor 68, as shown in FIG. 2. Placed below the evaporator coil is a water collecting pan 24 having a drain hole 26 which leads to a water drain 28. The pan 24 is positioned below the evaporator coil 22 to form an air passage 30 between the bottom wall 20 of the freezer compartment and the pan 24. Near the front end of the freezer space is an air aperture 32 extending through the bottom insulating wall 20 of the freezer space. A baffle 35 extends upwardly from a rear lower portion of the freezer space 12 and has an upper end in front of the rear wall 36 of the freezer space 12 to define an aperture 34. The rear air aperture 34 is in communication with the air passage 30.

The pan 24 has its front end spaced away from the front insulating wall 39 to define an air vent 37. Extending upwardly from the pan 24 is a baffle 41 which has an aperture 38 therethrough.

Extending vertically upward from a back edge of pan 24 is a wall 44 which is spaced apart from the rear wall 36 to define an air duct 40. The top section of the wall 44 has an aperture 42 therethrough. The air duct 40 extends from the aperture 42 to the upper rear section of the refrigerator space 14 and is in open communication therewith.

The apertures 32 and 38 have a solenoid operated damper 46 pivotably mounted therebetween and operable to close either one of apertures 32 or 38. A spring is mounted on damper 46 and exerts a force to move the damper 46 to close aperture 32.

A second solenoid aperture damper 48 is similarly positioned between apertures 34 and 42 and has a spring 49 mounted thereon and exerts a force to move damper 48 to close aperture 34.

A fan 50 is positioned within the air passage 30 so as to draw the air from either the freezer aperture 12 through aperture 32 or refrigerator space 14 through aperture 38 and through air passage 30 and to force the air through apertures 34 and 42. A fan shroud 52 extends forwardly from vertical wall 44 and defines a fan exhaust chamber 54.

At the rear end of the evaporator coil 22 is a temperature sensitive switch 56.

A second temperature sensitive switch 58 is positioned within the refrigerator space. Also, mounted within the refrigerator space 14 is a light 66.

The operation of the refrigeration unit 10 can be more clearly described with reference to FIG. 2. FIG. 2 discloses an electrical diagram wherein leads 60 and 62 are connected to a power source (not shown). Switch 64 and light 66 are connected in series with leads 60 and 62. Switch 65 and fan 50 are connected in parallel to the switch 64 and light 66. Temperature sensitive switch 56 is connected in parallel to the switches 65 and 64. In series with temperature sensitive switch 56 is compressor 68. In series with switch 56, but parallel to compressor 68, is a second temperature sensitive switch 58. Operably connected in series with the second switch 58 are two parallel connected solenoids 67 and 69 which control dampers 46 and 48 respectively.

Switch 64 is operably connected to the refrigerator door 18. Switch 64 is open when the refrigerator door is closed. When the refrigerator door is open, the switch 64 is closed and the light is turned on.

The switch 65 is closed when both the freezer or refrigerator door are closed. When the door is opened, the switch 65 is open and the fan 50 is deactuated.

The temperature sensitive switch 56 controls the compressor 68 and solenoids 67 and 69 which operate dampers 46 and 48 respectively. The temperature sensitive switch 56 opens when the temperature of the evaporator coil is cooled below a predetermined low temperature below 0° C. (32° F.). The open switch 56 deactuates the compressor 68 to the evaporator coil 22 and de-energizes the solenoid 67 and 69 to the dampers 46 and 48 respectfully. For example, the predetermined low temperature can be −4° F. The temperature sensitive switch 56 will remain open until the evaporator coil is warmed by the warmer refrigerator compartment air to a predetermined high temperature above the freezing point of water (0° C. or 32° F.). For example, the predetermined high temperature can be 37° F.

This allows the evaporator to be warmed above the freezing point of water so that any ice or frost will melt from the evaporator coils when the compressor is deactuated. In addition, the temperature sensitive switch 56 will deactuate the solenoids 67 and 69 which are operably connected to the dampers 46 and 48 respectively. When the solenoids 67 and 69 are deactuated, the springs 47 and 49 will pivot the dampers 46 and 48 closed with respect to the apertures 32 and 34 so that the freezer space is closed off to the circulating air through the fan 50. Conversely, the apertures 38 and 42 are opened with respect to the dampers 46 and 48 so that the air can pass from apertures 38 through air passage 30 and across the evaporator coil 22 through fan shroud 52 and then through air apertures 42 and air duct 40.

The air passing through the evaporator coil 22 cools the refrigerator space 14. When the switch 56 closes and the refrigerator space 14 is cool enough, the solenoids 67 and 69 will pivot the dampers against the force of the springs 47 and 49, to close apertures 38 and 42 and open apertures 32 and 34 to the freezer space 12.

To allow the refrigerator to be sufficiently cooled before the air through the air passage 30 is directed to the freezer space 12, the second temperature sensitive switch 58 is set to open when the temperature of the air in the refrigeration compartment is above a predetermined temperature such as 38° F. The switch 58 will, in effect, keep the dampers 46 and 48 closed with respect to the freezer space 12 and open with respect to the refrigerator space 14 after the switch 56 closes to actuate the condenser 68 if the refrigerator space 14 is too warm. Air from the refrigerator space 14 can pass over and across the cooled evaporator and directed back to the refrigerator space 14. When the refrigerator space 14 is sufficiently cooled, the temperature sensitive switch 58 will close and the solenoids 67 and 69 will pivot the dampers 46 and 48 to close the refrigerator space 14 off and open the freezer space 12 so that the cold air from the evaporator enters the freezer compartment 12.

When the evaporator coil 22 reaches its predetermined low temperature, it is shut off and the cycle is again repeated. In this fashion, the accumulation of frost is eliminated since the evaporator 22 in every cycle is sufficiently warmed above the melting point of water to drain off any of the accumulated frost thereon.

Figure 1:
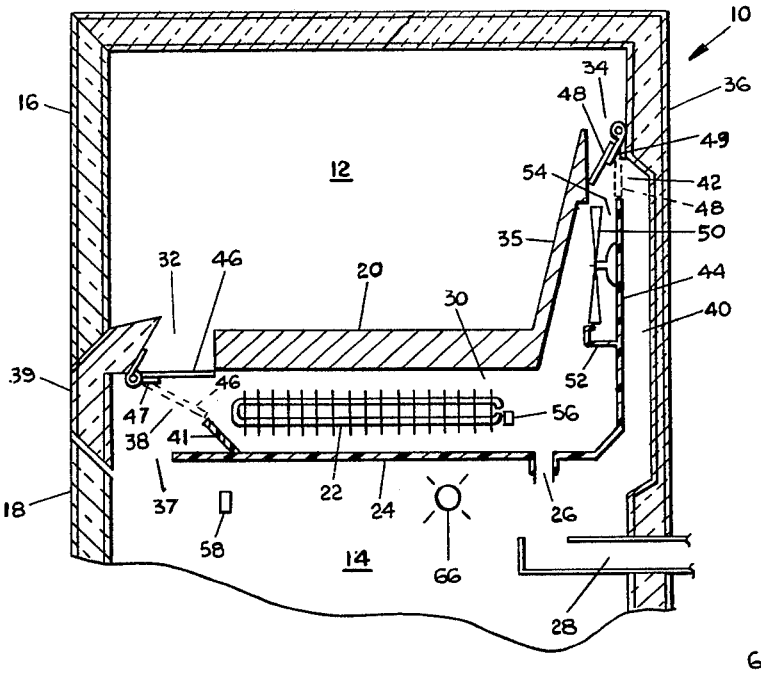
FIG. 1 is a partially schematic side elevational view of an embodiment according to the invention.
Figure 3:
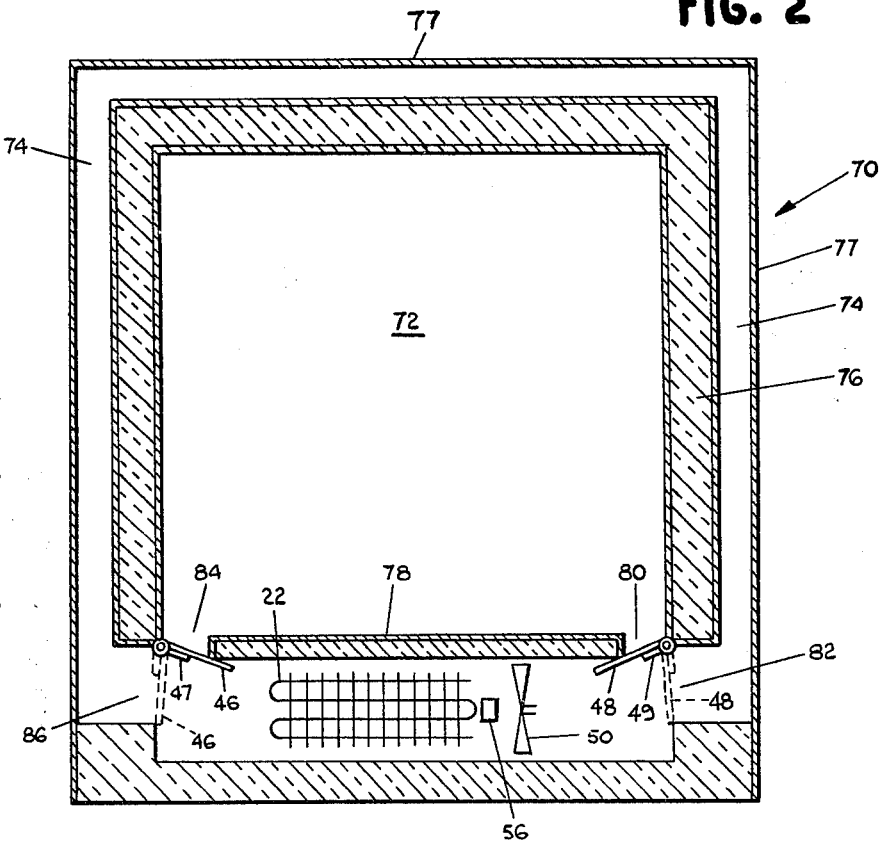
FIG. 3 is a partially schematic top elevational view of an alternative embodiment of the invention.

FIG. 3 shows an alternative embodiment of the invention to accommodate for a freezer unit 70. The freezer unit 70 has a freezer space 72 and a warmer air duct 74 positioned to the exterior of the insulating wall 76 but within the outer shell 77 of the freezer unit 70. To the side of the insulating wall 78 is evaporator 22. (Similar parts serving similar functions have the same numbers as shown in FIG. 1.) The temperature sensitive switch 56 is placed at one end of the evaporator 22 toward the fan 50. The fan 50 is operated to draw the air from the evaporator 22 and directs the air toward the damper 48. Damper 48 is spring biased with spring 49 to close either aperture 80 to the freezer space or aperture 82 to the warm air duct 74. Damper 46 is spring biased with spring 47 to close either the aperture 84 in open communication with the freezer space 72 or aperture 86 in open communication with the warm air duct 74.

Figure 4:
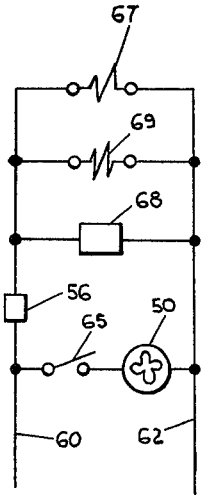
FIG. 4 is a schematic electrical diagram for the embodiment shown in FIG. 3.

The electrical system is shown in FIG 4. The leads 60 and 62 are connected to a power source (not shown). In series with the leads is switch 65 and fan 50. Switch 65 is opened when the freezer door (not shown) is open and closed when the freezer door is closed. Temperature sensitive switch 56 is parallel to switch 65 and fan 50. The compressor 68 and solenoids 67 and 69 are parallel to each other and connected in line with temperature sensitive switch 56.

The operation of the evaporator and solenoid operated dampers are the same as that for the refrigeration unit 10, which is shown in FIG. 1. The dampers 46 and 48 are positioned to close off the warm air duct when temperature sensitive switch 56 is closed and condenser is actuated and to close off the freezer space 72 when the switch 56 is open and the compressor is deactuated.

The freezer unit 70 may also be positioned so that the evaporator 22 and fan 50 are positioned below the freezer space 72 and the freezer door (not shown) is at the side of the unit.

The invention provides for a refrigeration defrost system which defrosts the evaporator coil using heat from the refrigeration compartment while cooling the refrigeration compartment at the same time. Considerable energy, estimated to be about 15%, can be saved with this automatic defrost system since extraneous external heat is not introduced into the system. In its broader concept, the invention provides for a defrost system which can utilize the warmer ambient air surrounding the refrigeration unit to provide an energy savings by eliminating the need to expand energy in heating elements.

It should be understood that various changes could be made in the above constructions without departing from the scope and spirit of the invention which is defined in the appended claims.

The embodiments of the invention in which an exclusive property or privilege is claimed are defined as follows:

1. In a refrigeration unit having a housing containing a freezer compartment;

an evaporator coil mounted within an air passage exterior to the freezer compartment;

a condenser and compressor operably connected to the evaporator coil for cooling air in heat exchange with the evaporator coil to a temperature below 0° C. (32° F.);

the air passage having a first set of apertures in open communication with the freezer compartment and a second set of apertures in open communication with a source of air;

means for circulating air either through the first set of apertures of the passageway so that air flows through the freezer compartment and across the evaporator coil in heat exchange therewith to cool the freezer compartment or through the second set of apertures of the passageway so that air having a temperature above 0° C. flows across the evaporator coils in heat exchange relationship therewith;

valve means for controlling the passage of air through the first and second set of apertures and through the air passageway;

temperature sensitive means mounted within one of the freezer compartment and air passageway for turning off the compressor when a first predetermined temperature is detected and for turning on the compressor when a second predetermined higher temperature is detected; the improvement comprising:

an air duct positioned outside the insulating walls of the freezer space and within the outer shell of the refrigeration unit in communication with the air passage to supply air above 0° C. to the evaporator coils;

means coupled to the temperature sensitive means for controlling the valve means to direct air from the above 0° source to pass through the second set of apertures and across the evaporator coil when the compressor is turned off and to use the first set of apertures to prevent air from circulating through the freezer compartment, the air passage being free from heating means so that the evaporator is defrosted only by heat exchange with the air from the above 0° C. source.

2. An apparatus as defined in claim 1 wherein the valve means closes off the second set of apertures when the compressor is turned on and closes off the first set of apertures when the compressor is turned off.

3. An apparatus as defined in claim 2 wherein the first and second sets of apertures have one aperture of the first set adjacent one aperture of the second set and the valve means comprises a damper pivotably mounted to close off an aperture of the second set in one position and to close off one of the apertures leading to the freezer compartment in a second position.

* * * * *